US005652975A

United States Patent [19]

Hoskin

[11] Patent Number: 5,652,975

[45] Date of Patent: Aug. 5, 1997

[54] AUTOMATIC TALKING POTTY APPARATUS

[76] Inventor: Glory S. Hoskin, 3410 E. 36th St., Indianapolis, Ind. 46218

[21] Appl. No.: 589,192

[22] Filed: Jan. 22, 1996

[51] Int. Cl.[6] ..... A47K 11/04

[52] U.S. Cl. ..... 4/661; 4/483; 4/902

[58] Field of Search ..... 4/661, 902, 449

[56] References Cited

U.S. PATENT DOCUMENTS

| | | |
|---|---|---|
| D. 343,891 | 2/1994 | Kessler . |
| D. 352,993 | 11/1994 | Boucher et al. . |
| 4,162,490 | 7/1979 | Fu et al. . |
| 4,777,680 | 10/1988 | Paz . |
| 4,883,749 | 11/1989 | Roberts et al. . |
| 5,008,964 | 4/1991 | Dean et al. . |

*Primary Examiner*—Charles E. Phillips

[57] ABSTRACT

An automatic talking potty apparatus includes a receptacle support assembly and a receptacle supported by the receptacle support assembly. A seating surface is positioned over the receptacle. A seated-child sensor assembly senses when a child has been seated on the seating surface. A control assembly is electrically connected to the seated-child sensor assembly. A gender-selection switch is electrically connected to the control assembly. A female-gender message device and a male-gender message device are selectively responsive to the gender-selection switch. The receptacle support assembly includes a set of legs and a receptacle-support ledge supported by the legs. The seating surface is a portion of a seat unit which includes an access slot and a retention groove for receiving a portion of the receptacle. The receptacle includes an upper flange portion which is passed through the access slot and is received by the retention groove in the seat unit. More specifically, a pair of flange portions, a pair of access slots, and a pair of retention grooves are provided. The seated-child sensor assembly includes a pressure-sensitive switch. The control assembly includes a timer assembly. A seat back assembly is connected to the receptacle support assembly. The seat back assembly includes a back portion and a pair of arms. The gender-selection switch is housed in an electrical component housing. The gender-selection switch includes a selector handle.

10 Claims, 4 Drawing Sheets

FIG 5
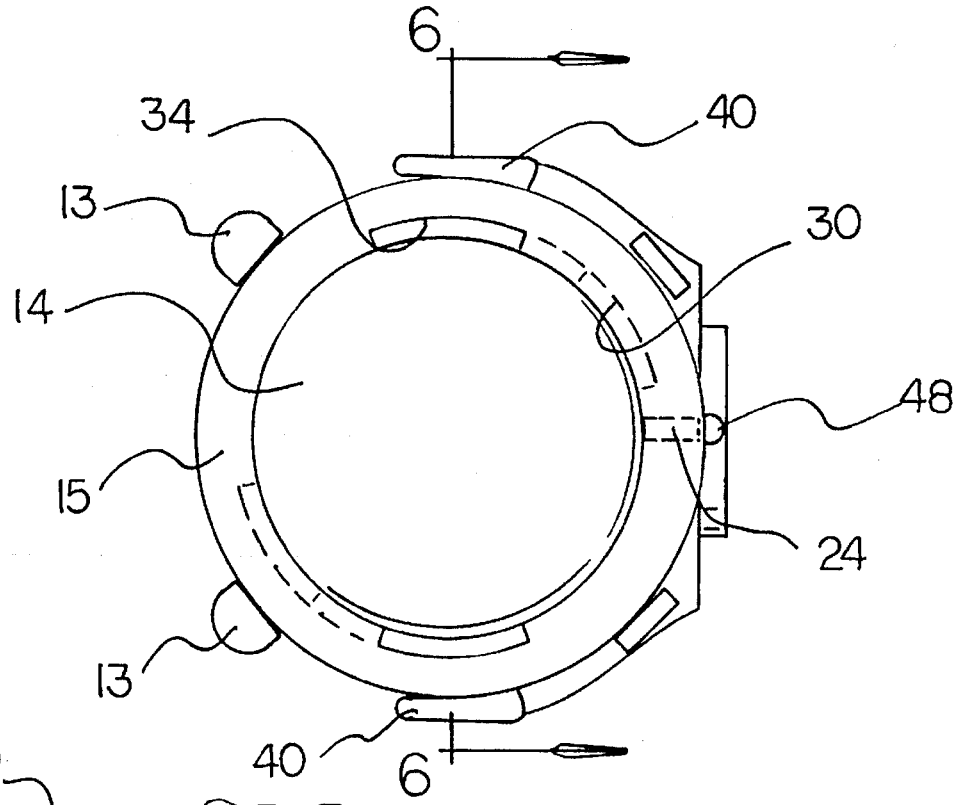
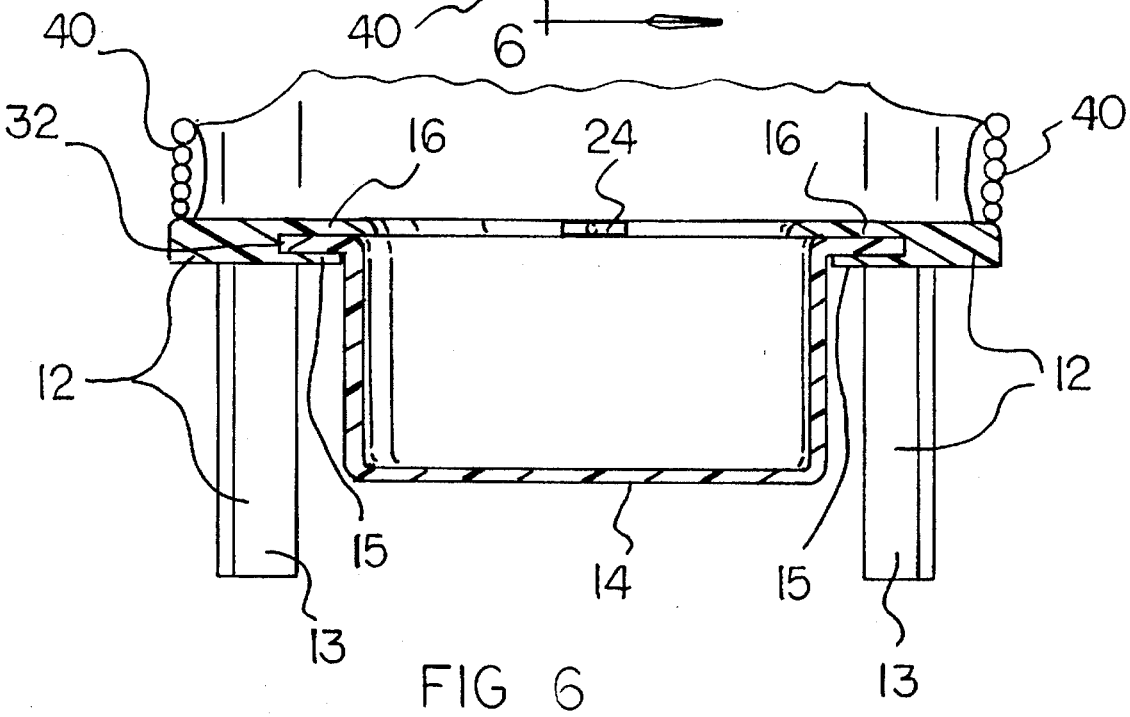
FIG 6

AUTOMATIC TALKING POTTY APPARATUS

BACKGROUND OF THE INVENTION

1. Field of the Invention

The present invention relates generally to potties for training children to develop good waste elimination habits and, more particularly, to potties that have pre-recorded messages.

2. Description of the Prior Art

One device that is commonly used to teach children good waste elimination habits is a potty. In its simplest form, the potty includes a seat and a receptacle for receiving wastes. However, throughout the years, a number of innovations have been developed relating to potties, and the following U.S. patents are representative of some of those innovations: U.S. Pat. Nos. 4,162,490, 4,777,680, 4,883,749, 5,008,964, U.S. Pat. No. Design 343,891, and U.S. Pat. No. Design 352,993. More specifically, each of U.S. Pat. Nos. 4,162,490, 4,883,749, and 5,008,964 discloses a child's potty that provides a child with a voice message once the child begins waste elimination. It is noted that the potties in the three just-cited patents are not gender specific. That is, one message is provided whether the child using the potty is a girl or a boy. Since a gender-specific message would be more personal than a gender-neutral message, it would be desirable if a polly provides a voice message that is gender specific.

Moreover, each of U.S. Pat. Nos. 4,162,490, 4,777,680, 4,883,749, and 5,008,964 discloses a potty that provides a sound response as the child is using the potty. None of the potties in the just-cited patents provides for providing the child a message after the child finishes with waste elimination. In this respect, it would be desirable if a potty provided a child with a voice message after waste elimination has taken place and after the child has risen from the potty seat.

As a matter of interest, each of U.S. Pat. Nos. Design 343,891 and Design 352,993 discloses a potty that employs simulated animal characters in the potty design.

Thus, while the foregoing body of prior art indicates it to be well known to use potties that provide voice messages, the prior art described above does not teach or suggest an automatic talking potty apparatus which has the following combination of desirable features: (1) provides a voice message that is gender specific; and (2) provides a child with a voice message after waste elimination has taken place and after the child has risen from the potty seat. The foregoing desired characteristics are provided by the unique automatic talking potty apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an automatic talking potty apparatus includes a receptacle support assembly and a receptacle supported by the receptacle support assembly. A seating surface is positioned over the receptacle. A seated-child sensor assembly senses when a child has been seated on the seating surface. A control assembly is electrically connected to the seated-child sensor assembly. A gender-selection switch is electrically connected to the control assembly. A female-gender message device and a male-gender message device are selectively responsive to the gender-selection switch.

The receptacle support assembly includes a set of legs and a receptacle-support ledge supported by the legs. The seating surface is a portion of a seat unit which includes an access slot and a retention groove for receiving a portion of the receptacle. The receptacle includes an upper flange portion which is passed through the access slot and is received by the retention groove in the seat unit. More specifically, a pair of flange portions, a pair of access slots, and a pair of retention grooves are provided.

The seated-child sensor assembly includes a pressure-sensitive switch. The control assembly includes a timer assembly. A seat back assembly is connected to the receptacle support assembly. The seat back assembly includes a back portion and a pair of arms. The gender-selection switch is housed in an electrical component housing. The gender-selection switch includes a selector handle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic talking potty apparatus which has all of the advantages of the prior art and none of the disadvantages.

It is another object of the present invention to provide a new and improved automatic talking potty apparatus which may be easily and efficiently manufactured and marketed.

It is a further object of the present invention to provide a new and improved automatic talking potty apparatus which is of durable and reliable construction.

An even further object of the present invention is to provide a new and improved automatic talking potty apparatus which is susceptible of a low cost of manufacture with regard to both materials and labor, and which accordingly is then susceptible of low prices of sale to the consuming public, thereby making such automatic talking potty apparatus available to the buying public.

Still yet a further object of the present invention is to provide a new and improved automatic talking potty apparatus which provides a voice message that is gender specific.

Still another object of the present invention is to provide a new and improved automatic talking potty apparatus that provides a child with a voice message after waste elimination has taken place and after the child has risen from the potty seat.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is a bottom view of the embodiment of the invention shown in FIG. 2 taken along line 5—5 thereof.

FIG. 6 is an enlarged cross-sectional view of the portion of the embodiment of the invention shown in FIG. 5 taken along line 6—6 thereof.

DESCRIPTION OF THE PREFERRED EMBODIMENT

Figure 1:
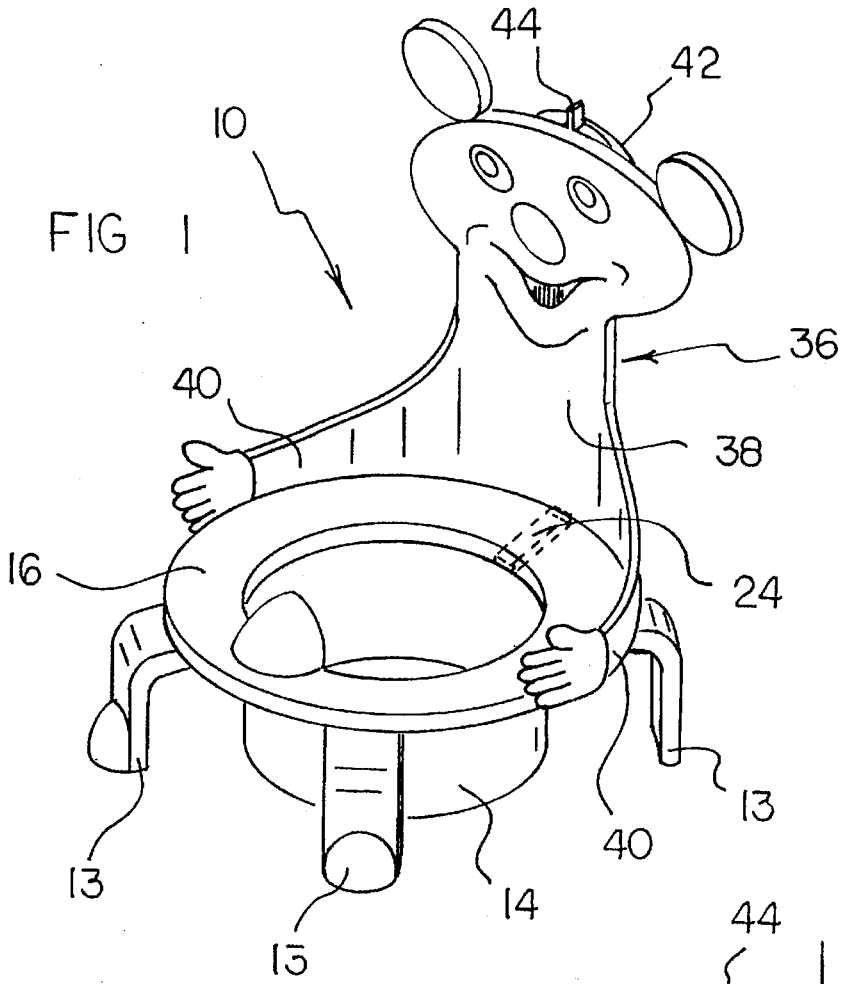
FIG. 1 is a perspective view showing a preferred embodiment of the automatic talking potty apparatus of the invention.
Figure 2:
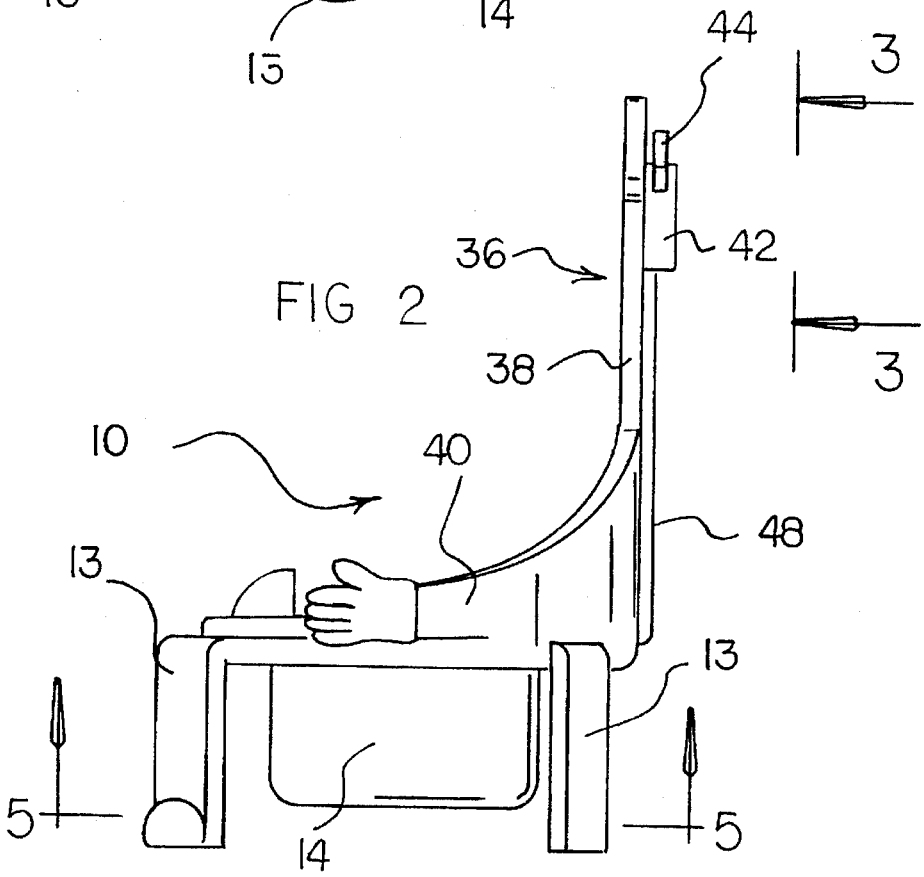
FIG. 2 is an enlarged side view of the embodiment of the automatic talking potty apparatus shown in FIG. 1.
Figure 3:
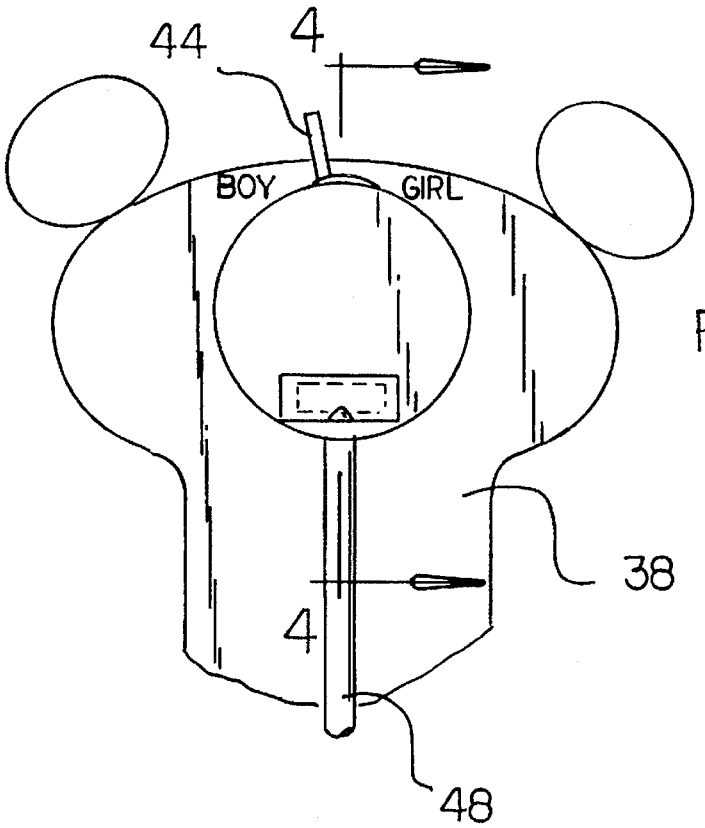
FIG. 3 is enlarged rear view of the portion of the embodiment of the automatic talking potty apparatus of FIG. 2 taken along line 3—3 thereof.
Figure 4:
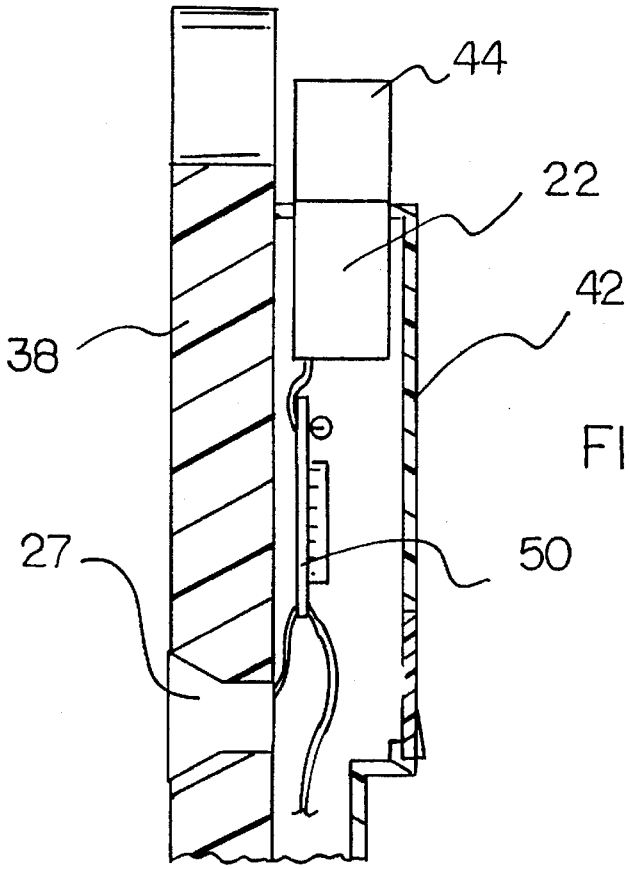
FIG. 4 is an enlarged cross-sectional view of the portion of the embodiment of the invention shown in FIG. 3 taken along line 4—4 thereof.

With reference to the drawings, a new and improved automatic talking potty apparatus embodying the principles and concepts of the present invention will be described.

Turning to FIGS. 1–7, there is shown an exemplary embodiment of the automatic talking potty apparatus of the invention generally designated by reference numeral 10. In its preferred form, automatic talking potty apparatus 10 includes a receptacle support assembly 12 and a receptacle 14 supported by the receptacle support assembly 12. A seating surface 16 is positioned over the receptacle 14. A seated-child sensor assembly senses when a child has been seated on the seating surface 16. [A control or timer assembly is electrically connected to the seated-child sensor assembly.] A gender-selection switch 22 is electrically connected to the control assembly. A female-gender message device 25 and a male-gender message device 26 are selectively responsive to the gender-selection switch 22. The female-gender message device 25 and the male-gender message device 26 can be connected to an amplifier assembly 27 for amplifying the sound produced by the female-gender message device 25 and the male-gender message device 26.

The receptacle support assembly 12 includes a set of legs 13 and a receptacle-support ledge 15 supported by the legs 13. The seating surface 16 is a portion of a seat unit which includes an access slot 34 and a retention groove 30 for receiving a portion of the receptacle 14. The receptacle 14 includes an upper flange portion 32 which is passed through the access slot 34 and is received by the retention groove 30 in the seat unit. More specifically, a pair of flange portions 32, a pair of access slots 34, and a pair of retention grooves 30 are provided.

The seated-child sensor assembly includes a pressure-sensitive switch 24. The timer assembly 20 is connected between the seated-child sensor assembly and the gender-selection switch 22. A seat back assembly 36 is connected to the receptacle support 12. The seat back assembly 36 includes a back portion 38 and a pair of arms 40.

The gender-selection switch 22 is housed in an electrical component housing 42. The gender-selection switch 22 includes a selector handle 44. The timer assembly 20, the gender-selection switch 22, the female-gender message device 25, and the male-gender message device 26 are housed in the electrical component housing 42. Also housed in the electrical component housing 42 is a power supply 46, e.g. a battery.

The pressure-sensitive switch 24 is placed adjacent to the seating surface 16. Electrical conductors run, in a conduit 48, from the pressure-sensitive switch 24 to the power supply 46 and the timer assembly 20. The timer assembly 20, the female-gender message device 25, the male-gender message device 26, and the power supply 46 are carried by a circuit board 50.

In using the automatic talking potty apparatus 10 of the invention, the legs 13 are placed on the floor. The flange portions 32 of the receptacle 14 are inserted into the access slots 34 of the seat unit, and the receptacle 14 is rotated to have the flange portions 32 enter the retention grooves 30 in the seat unit. In this way, the receptacle 14 is supported by the seat unit.

Figure 7:
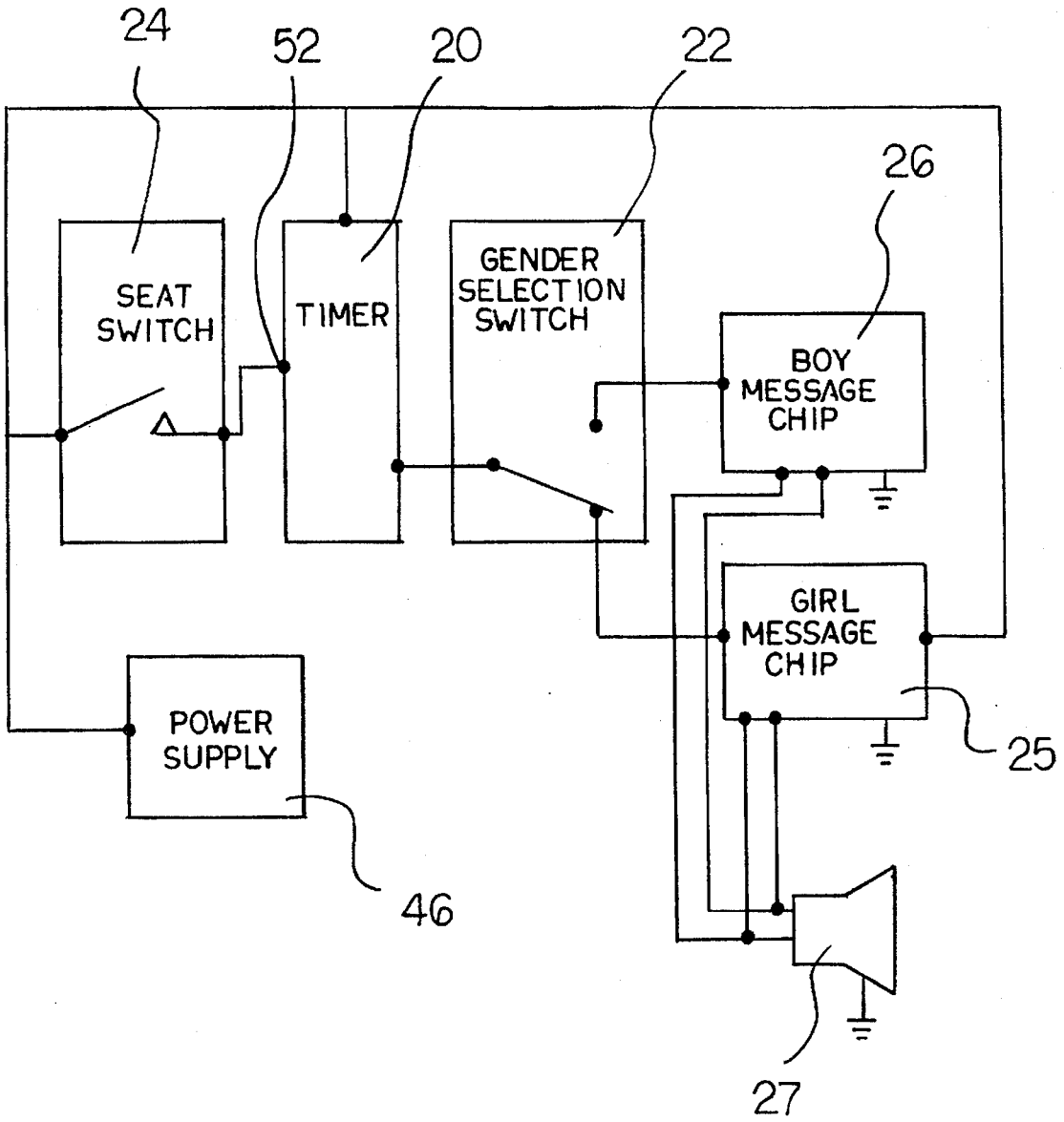
FIG. 7 is an electrical circuit diagram, in block form, of electrical components employed for the embodiment of the invention shown in FIG. 1.

A person, either an adult or child, moves the selector handle 44 of the gender-selection switch 22 to select for use of the automatic talking potty apparatus 10 by either a girl or a boy. As shown in FIG. 7, the gender-selection switch 22 is in a position for a girl to use the apparatus of the invention. A girl child sits on the seating surface 16, and this causes the pressure-sensitive switch 24 to sense the presence of the seated child. With the child seated on the seating surface 16, the pressure-sensitive switch 24 is closed, and this causes the timer assembly 20 to be reset at the reset input 52. As long as the reset input 52 is receiving input from the pressure-sensitive switch 24, the timer assembly 20 will not run. After the female child (for the setting shown in FIG. 7) rises from the seating surface 16, the pressure-sensitive switch 24 will open. When this occurs, the reset input 52 no longer receives a reset signal. Then, the timer assembly 20 begins to run for a predetermined period of time, and the timer assembly 20 provides power to the female-gender message device 25 which allows generation of the female's message from the female-gender message device 25 which is amplified by the amplifier assembly 27. After the timer assembly 20 runs its course, power ceases to flow to the female-gender message device 25. Then, the automatic talking potty apparatus 10 of the invention is ready for another seating by a female child.

On the other hand, if a male child is to use the potty, the gender-selection switch 22 is moved to the male position, so that a male message from the male-gender message device 26 will be played after a male child rises from the seating surface 16.

Besides the timer assembly 20, other suitable control assemblies can be employed. Moreover, besides the pressure-sensitive switch 24, other suitable seated-child sensor assemblies can be employed. The female-gender message device 25 and the male-gender message device 26 can be well known voice generating chips such as disclosed in U.S. Pat. No. 5,008,964, incorporated herein by reference. Alternatively, the female-gender message device 25 and the male-gender message device 26 can be cassette tape recorders/players such as disclosed in U.S. Pat. No. 4,162,490, incorporated herein by reference.

To remove the receptacle 14 from the seat unit, the receptacle 14 is rotated in an opposite direction, and the flange portions 32 of the receptacle 14 are moved out of the retention grooves 30 and lowered from the access slob 34 in the seat unit.

An example of a message for a female child can be, "Big girl, you have used the pot. Now it is time to go wash your hands. Very good." An example message for a male child can be, "Big boy, you have used the pot. Now it is time to go wash your hands. Very good." The seat back assembly 36 can be in the form of cartoon characters or other simulated characters, whether human or animal.

The components of the automatic talking potty apparatus of the invention can be made from inexpensive and durable metal and plastic materials and electronic components.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved automatic talking potty apparatus that is low in cost, relatively simple in design and operation, and which may advantageously be used to provide a voice message that is gender specific. With the invention, an automatic talking potty apparatus provides a child with a voice message after waste elimination has taken place and after the child has risen from the potty seat.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and desert bed in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An automatic talking potty apparatus, a receptacle support assembly, a waste receptacle supported by said receptacle support assembly, a seating surface positioned over said receptacle, a seated-child sensor assembly which produces a signal as long as a child is seated on said seating surface, a timer assembly electrically connected to said seated-child sensor assembly, for receiving a signal therefrom, a gender-selection switch electrically connected to said timer assembly, a female-gender message device selectively responsive to said gender-selection switch, a male-gender message device selectively responsive to said gender-selection switch, wherein, when a child is no longer seated, said timer will provide power to one of the female-gender message or male-gender message device previously selected by said gender-selection switch.

2. The apparatus of claim 1 wherein said receptacle support assembly includes a set of legs and a receptacle-support ledge supported by said legs.

3. The apparatus of claim 1 wherein said seating surface is a portion of a seat unit which includes an access slot and a retention groove for receiving a portion of said receptacle.

4. The apparatus of claim 3 wherein said receptacle includes an upper flange portion which passed through said access slot and is received by said retention groove in said seat unit.

5. The apparatus of claim 1 wherein said seated-child sensor assembly includes a pressure-sensitive switch.

6. The apparatus of claim 1 wherein said control assembly includes a timer assembly.

7. The apparatus of claim 1, further including a seat back assembly connected to said receptacle support assembly.

8. The apparatus of claim 7 wherein said seat back assembly includes a back portion and a pair of arms.

9. The apparatus of claim 1 wherein said gender-selection switch is housed in an electrical component housing.

10. The apparatus of claim 1 wherein said gender-selection switch includes a selector handle.

* * * * *